US007163163B2

(12) United States Patent
Waddelow

(10) Patent No.: US 7,163,163 B2
(45) Date of Patent: Jan. 16, 2007

(54) WIDE ANGLE NOZZLE FOR AGRICULTURAL SPRAYERS

(75) Inventor: Simon J. Waddelow, Ely (GB)

(73) Assignee: Hypro, LLC, New Brighton, MN (US)

( * ) Notice: Subject to any disclaimer, the term of this patent is extended or adjusted under 35 U.S.C. 154(b) by 191 days.

(21) Appl. No.: 10/614,445

(22) Filed: Jul. 7, 2003

(65) Prior Publication Data

US 2005/0045752 A1 Mar. 3, 2005

(51) Int. Cl.
*B05B 1/00* (2006.01)

(52) U.S. Cl. ..... 239/597; 239/601; 239/599; 239/600; 239/590

(58) Field of Classification Search ..... 239/597, 239/600, 601, 599, 590
See application file for complete search history.

(56) References Cited

U.S. PATENT DOCUMENTS

| | | | | |
|---|---|---|---|---|
| 40,847 | A | | 12/1863 | Macy |
| 477,824 | A | | 6/1892 | Robinson |
| 645,027 | A | | 3/1900 | Baker |
| 2,683,627 | A | * | 7/1954 | Wahlin ..... 239/597 |
| 2,985,384 | A | | 5/1961 | Martin |
| 3,486,700 | A | | 12/1969 | Bristow |
| 3,503,554 | A | | 3/1970 | Clifton |
| 3,985,303 | A | | 10/1976 | Steimle |
| 4,077,424 | A | | 3/1978 | Ehret |
| 4,264,039 | A | | 4/1981 | Moreland |
| 4,383,529 | A | | 5/1983 | Webster |
| 4,899,937 | A | * | 2/1990 | Haruch ..... 239/289 |
| 4,989,788 | A | * | 2/1991 | Bendig et al. ..... 239/429 |
| 5,564,448 | A | * | 10/1996 | Lincoln ..... 134/166 R |
| 6,079,638 | A | | 6/2000 | Chang |

FOREIGN PATENT DOCUMENTS

| | | |
|---|---|---|
| GB | 523104 | 7/1940 |

OTHER PUBLICATIONS

Dolce, Thomas, et al. "Acetal Resins", Chapter: Acetylene—Terminated prepolymers, Celanese Engineering Resins Co., pp. 4-5, Printed prior to Jul. 2003.

* cited by examiner

*Primary Examiner*—Dinh Q. Nguyen
(74) *Attorney, Agent, or Firm*—Michael Best & Friedrich LLP

(57) ABSTRACT

A spray nozzle system includes a spray tip having an elongated slot-shaped discharge opening for defining a flat fan spray pattern that subtends a wide angle, a cap body carrying the spray tip in fixed relation thereto and adapted to attach the spray tip to a supply fitting for tapping a supply of material to be sprayed in fixed aligned relation thereto and a flow regulating insert carried in the spray tip for connecting the spray tip to the supply of material to be sprayed and for controlling the amount of flow through the nozzle.

20 Claims, 6 Drawing Sheets

WIDE ANGLE NOZZLE FOR AGRICULTURAL SPRAYERS

BACKGROUND OF THE INVENTION

I. Field of the Invention

The present invention relates generally to spray nozzles and more particularly the spray nozzle used in the application of fluid agricultural chemicals such as fertilizers, herbicides, insecticides, fungicides and related materials to crops. Specifically, the present invention relates to removable flood tip nozzle arrangements for fluid spray applicators, which include a wide angle flat fan spray tip or nozzle fed through a flow regulating insert which may be removable and interchangeable with other inserts to modify performance, the nozzles are designed to spray straight downward at relatively high velocity and produce large droplets. The overall effect is one of high, localized flow with little drift.

II. Related Art

Most agricultural fluid spray application systems are designed to be pulled through fields mounted behind farm vehicles. These systems typically include one or more storage or supply vessels which serve as sources of material to be applied, some type of extended boom or other manifold system which carries a plurality of geometrically arranged spaced nozzles along its length together with connecting piping for carrying the material from the supply vessels or tanks to the manifold and so to the array of output nozzles. At least one pump is provided for forcing the material from the storage tanks under pressure through the piping to the nozzles for spray discharge. The pattern of the spaced nozzle arrangement is designed to perform uniform application to a fairly wide swath as the towing vehicle moves through the field.

Recent developments in crop spraying, on the one hand, have been directed to increasing productivity by increasing the capacity of sprayers and thereby reducing the time necessary for those conducting the spraying to accomplish coverage of a given area. This has led to the development of relatively high volume "flood" type spray nozzles particularly for large boom-type application devices. On the other hand, however, more and more attention is being paid to the effect that agricultural spraying has on the environment. One particular problem in this regard relates to overspraying or drift of airborne minute liquid spray droplets, which may be carried downwind unintentionally beyond the borders of the area intended to be covered.

Consequently, there exists a very real need to provide spray equipment that enables expeditious application of agriculture chemicals to a desired area but which, at the same time, minimizes overspray or drift beyond the bounds intended to be treated. Thus, there is also a need for a nozzle system that can be used to directly apply fluid material at high flow rates to enable coverage of relatively large areas in relatively short time spans which, also reduces or eliminates overspray drift of such materials.

SUMMARY OF THE INVENTION

The present invention overcomes many problems associated with overspray and drift in high volume, high pressure flood type agriculture spray nozzle devices by the provision of a spray nozzle system having a spray tip incorporating an elongated slot-shaped discharge opening that provides a relatively flat "fan" spray pattern that subtends a wide angle. The spray nozzle includes a cap body fixture formed integrally with or otherwise permanently fixed to the spray tip. The cap is further provided with a turn-lock type connection system for removably attaching and locking the cap to a conventional compatible hollow supply fitting having a tubular outlet opening on a boom manifold or other spray device that is, in turn, connected to a source of the material to be sprayed. Because the cap always locks in the same relative position, when the cap is in the locked position, the slot-shaped discharge opening in the spray tip is aligned in a corresponding predetermined orientation.

The cap and spray tip nozzle combination of the invention is further provided with a hollow tubular flow regulating nozzle insert device situated in line between the supply fitting inlet connection and the spray tip. The flow regulating insert includes a flow control or metering aspect that determines nozzle output. While it can be also an integral part of the system, preferably the regulating nozzle insert is a snap-fitting device which is removable and interchangeable with other metering inserts having different capacities to thereby offer a variety of flow rates at a given output pressure differential. The insert connects the spray tip to the outlet opening of the supply fitting at and a proximal end and it is sealed using an o-ring or other type liquid-tight gasket device. Preferably the flow regulating aspect of the nozzle insert device is an orifice integrally molded into the device.

Optionally, a cross-hair diffuser insert can be employed between the flow regulating nozzle insert and the spray tip to modify or improve stability and desired spray pattern. The diffuser may be snap or push fitted into the metering or regulating nozzle insert such that it can also be easily removed if desired. The diffuser may be oriented as desired relative to the main cap using a location key. In addition, a slot shroud may be utilized on the orifice tip to extend spray containment and reduce lateral spread or "thickness".

The spray nozzle of the present invention is generally of a class intended to be mounted or aligned as one of a plurality of identical spray nozzles in spaced relation along a boom manifold such that wide lateral area may be simultaneously sprayed. Because the slot-shaped discharge opening in the spray tip produces a relatively flat fan-shaped spray pattern that subtends a wide angle, nominally greater than 90° and possibly 160°, the alignment of consecutive spray nozzles in a predetermined orientation that avoids interference between the sprays of the adjacent nozzles becomes important.

The spray nozzle system of the present invention can be manufactured out of any of many materials that would properly function in the role. Preferred materials include high impact plastic such as poly acetal resins. Spray tips may be molded integrally with the cap portion of the nozzle system or separately molded and fixed thereto during assembly. The slot-shaped discharge opening in the spray tip may also be provided after the tip has been molded with or assembled in the cap. The single piece system of course, assures the proper orientation of the slot-shaped discharge opening relative to the cap. Likewise, the flow-regulating insert may be molded as an integral part of the system but is preferably a removable snap-fitting separate piece. The attachment of the cap to the source of supply is normally a finger operated turn-lock type system which enables nozzles to be readily removed and reattached or replaced with other nozzles, as desired.

BRIEF DESCRIPTION OF THE DRAWINGS

In the drawings wherein like numerals designate like parts throughout the same.

DETAILED DESCRIPTION

Figure 1:
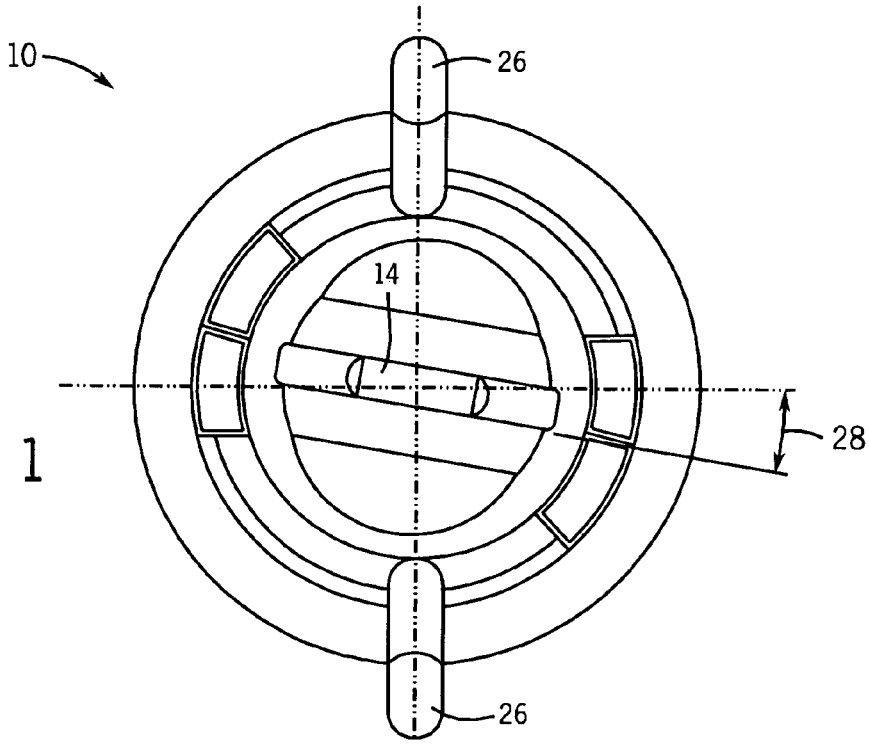
FIG. 1 is a top or front view of one embodiment of a wide-angle spray nozzle in accordance with present invention.
Figure 2:
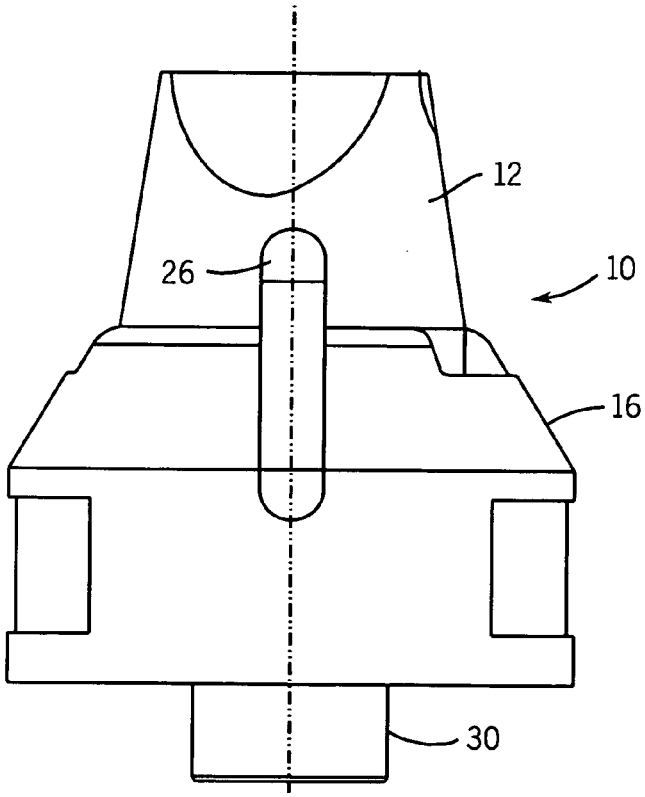
FIG. 2 is a side elevational view of the spray nozzle of FIG. 1.
Figure 3:
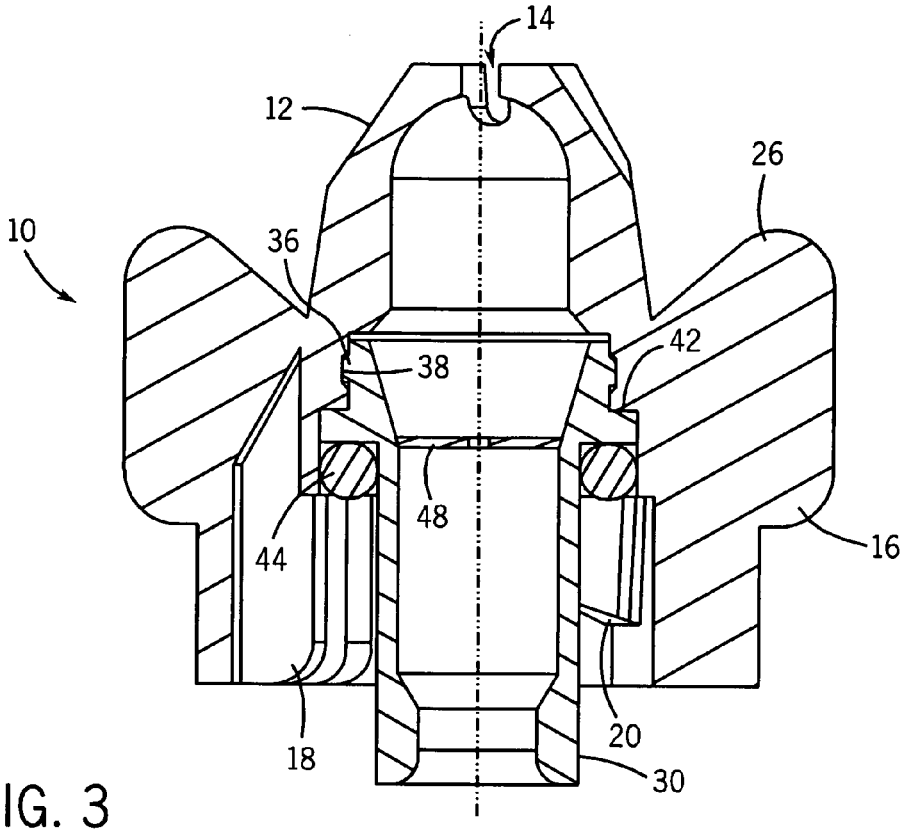
FIG. 3 is a sectional view through the spray nozzle of FIGS. 1 and 2.

The present invention provides high-volume, low-pressure spray nozzle system that produces a high volume, large droplet low drift spray. The nozzle system includes a spray tip incorporating in the elongated shaped discharge opening that provides a spray pattern subtending a wide angle. The spray nozzle system includes a cap body that is fixed to or formed integrally with the spray tip. The cap and spray tip combination is further provided with an in-line flow regulating insert device which may be interchangeable with other such devices to modify the spray nozzle output. The cap fits a conventional accommodating supply fitting in a sprayer system connected to a source of spray material and is provided with a conventional rotating locking system which locks the spray tip in a predetermined orientation relative to the supply fitting.

The spray nozzle system of the invention may take any of several forms and those illustrated by the drawings and detailed description contained herein are provided as illustrations of the invention rather than with any intention to limit the scope of the invention in any manner.

Accordingly, FIGS. 1–4 illustrate one preferred embodiment of the spray nozzle system of the invention. As seen in the figures, the spray nozzle system, generally at 10, includes a spray tip 12 having an elongated slot-shaped discharge opening 14 defining a fan-shaped flat spray pattern that subtends a wide angle. The spray tip 12 is carried in a cap body 16 permanently adhered in fixed relation thereto. The spray tip 12 may also be constructed or molded integrally with the cap body as a unitary structure. The cap body 16 includes reinforcing ribs as at 18 and a pair of opposed spiral grooves one of which is shown at 20 (FIG. 3) which attach the spray nozzle system to a supply fitting at 22 (FIG. 4) using a pair of corresponding fastening lugs 24. A pair of wings 26 are provided on the cap body 16 as finger grips for rotating the cap body 16 to attach and detach the nozzle from the supply fitting 22. The nozzle is keyed to the members 24 such that with the spiral grooves 20 it can be pushed and, in turn, locked to the supply fitting 22 readily by hand in a "bayonet" method of attachment. This enables easy attachment and removal of the spray nozzle system 10 while assuring that it locks in place in a specific orientation each time.

The slotted opening 14 is designed to be oriented at an offset angle 28, which may between 5° and 15° and is typically about 5°–10° as illustrated in FIG. 1 at 28. This avoids overlap and interference between adjacent nozzles on a boom, as will be described.

The spray nozzle system further includes a metering stem or flow regulating insert stem 30 having a first end 32 designed to be received in the supply fitting 22 and a second end 34 designed to be received in the spray tip/cap body system to supply spray material to the spray tip. The flow-regulating insert stem 30, toward the end 34, is provided with a raised ridge 36 designed to be snap fit into a corresponding recess 38 in the spray tip/cap structure. A shoulder 40 is also provided which is designed to abut a corresponding recess shoulder 42 in the spray tip/cap structure. The spray nozzle system connection to the fitting 22 is made liquid tight by the addition of an O-ring 44 designed to nest against the ridge 40 of the sealing it to the end of the fitting 22 at 46 when the nozzle system is assembled on to the fitting 22.

Figure 5:
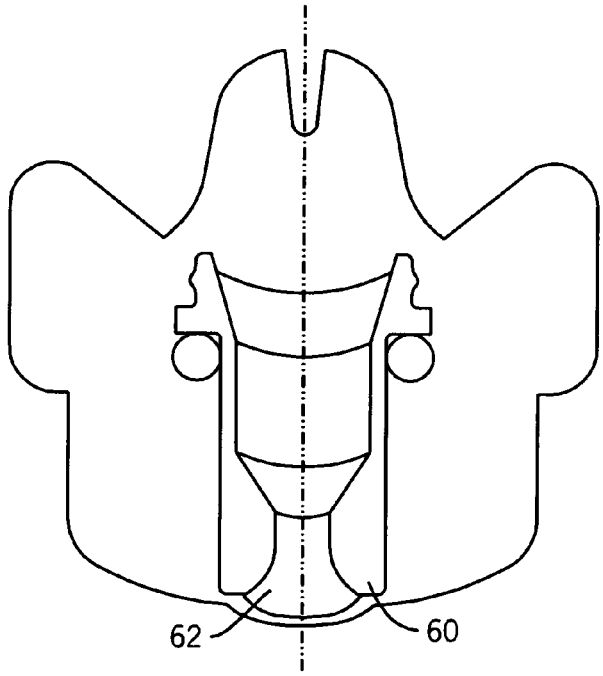
FIG. 5 is a representation of an alternative embodiment of the spray nozzle of the invention with parts broken away.
Figure 4:
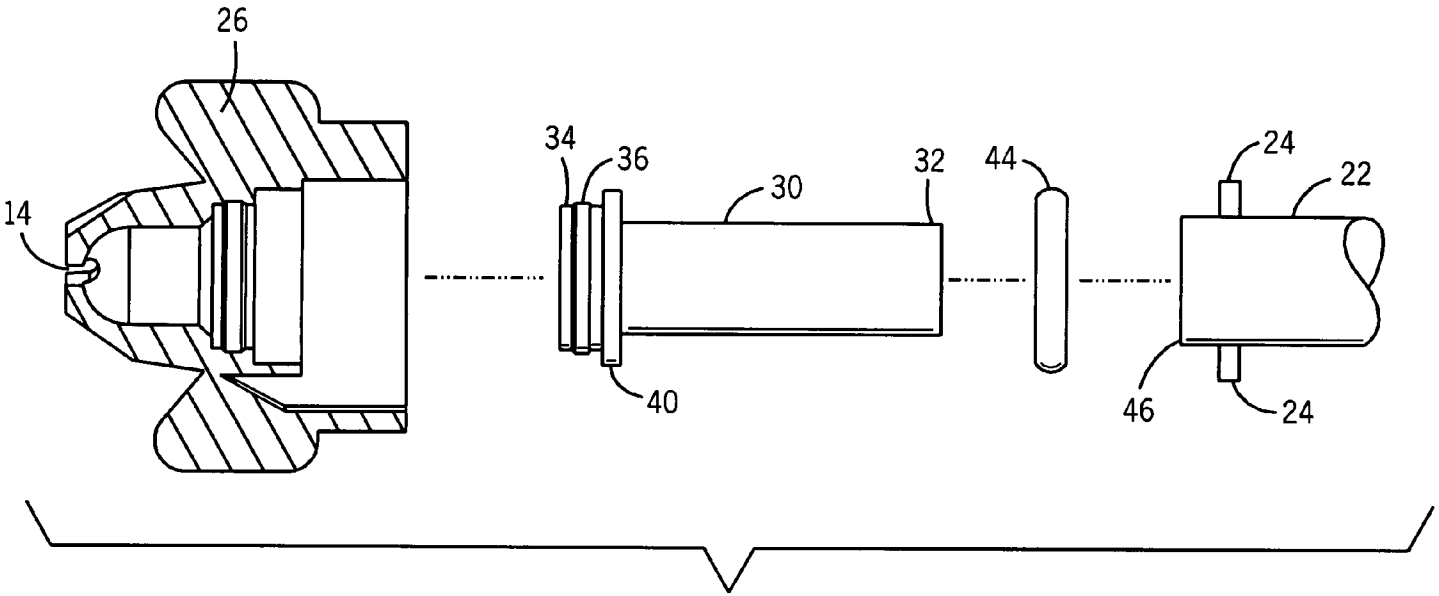
FIG. 4 is an exploded view of the spray nozzle of FIGS. 1–3.
Figure 6:
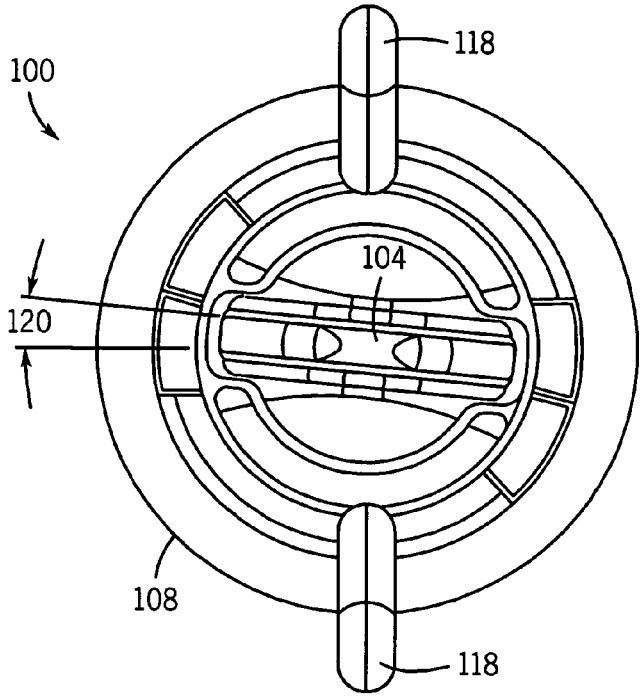
FIG. 6 is a top or front view of an alternate embodiment of a wide-angle spray nozzle in accordance with the invention.
Figure 7:
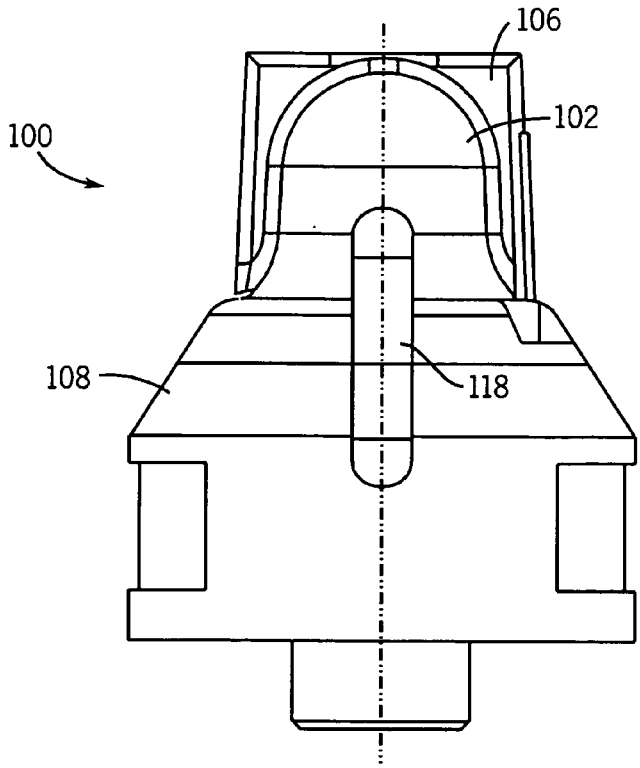
FIG. 7 is a side elevational view of the spray nozzle of FIG. 6.
Figure 8:
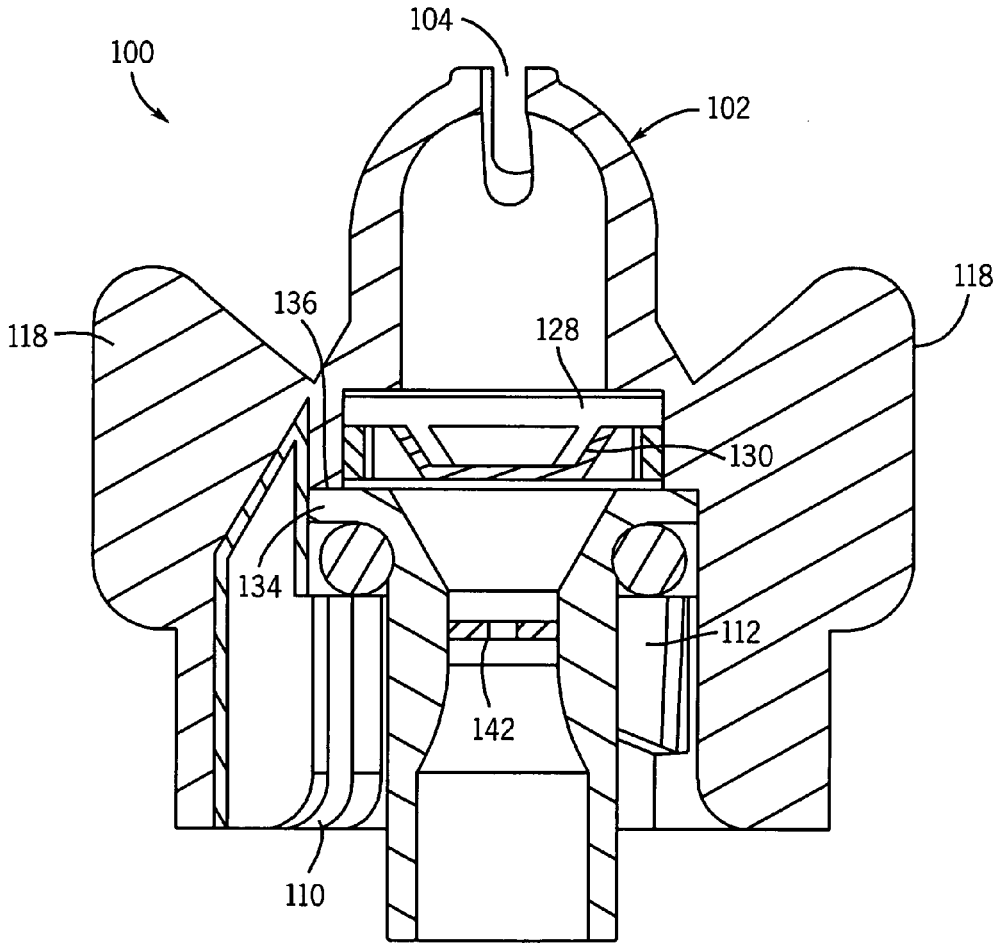
FIG. 8 is a sectional view of the spray nozzle of FIGS. 6 and 7 along line A—A.
Figure 9:
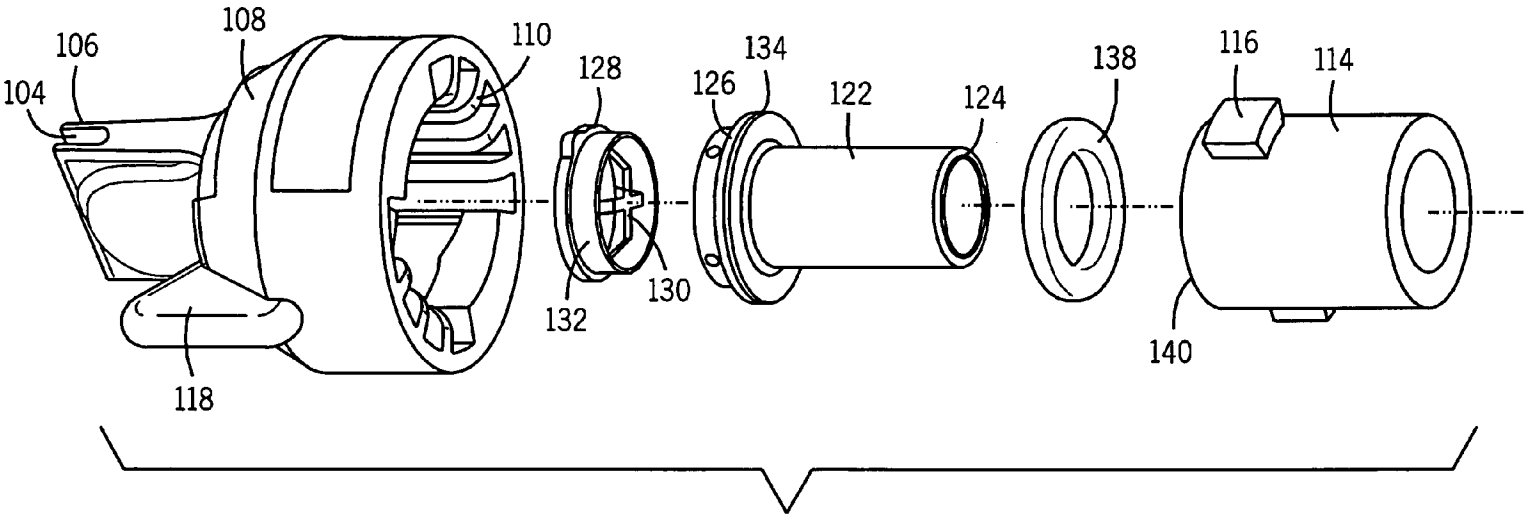
FIG. 9 is an exploded perspective view of the embodiment of the spray nozzle of FIGS. 6–8.

The flow-regulating insert stem 30 is, of course, in the form of a hollow tubular member as is the fitting 22 so that flow can be maintained between the fitting 22 and the output slot-shaped discharge opening 14. Within the structure of the flow regulating insert, there is provided a further flow-regulating device which may be in the form of an orifice meter as at 48 having an opening of a known diameter which produces a known output of spray at a given system operating pressure. The alternate embodiment illustrated at FIG. 5 illustrates the use of an insert 60 having an internal venturi-type metering system 62 instead of the orifice meter shown in the embodiment of FIGS. 1–4. It will be recognized that any suitable type of liquid metering system can be utilized in the spray nozzle system of the invention.

FIGS. 6–9 illustrate an alternative preferred embodiment of the spray nozzle system of the invention which, although generally similar, differs in certain respects. The spray nozzle system of the alternate embodiment is shown generally at 100 and also includes a spray tip 102 having an elongated slot-shaped discharge opening 104 defining a fan-shaped flat spray pattern that subtends a wide angle. The tip also includes a slot shroud 106 which includes members that flank the discharge opening. The shroud further extends spray containment to enhance the nature of the fan-shaped flat spray pattern by further reducing its spread perpendicular to the slotted opening 104 or thickness.

As with the previous embodiment, the spray tip 102 is carried in a cap body 108 permanently adhered in fixed relation thereto and may also be constructed or molded integrally with the cap body as a unitary structure. The cap body 108 includes reinforcing ribs as at 110 and a pair of opposed spiral grooves, one of which is shown at 112 (FIG. 8) which attach the spray nozzle system to a supply fitting as shown at 114 in FIG. 9 using a pair of corresponding fastening lugs 116 in a bayonet-type attachment. A pair of thumb wings 118 are provided on the cap body 108 as finger grips for rotating the cap body 108 to attach and detach the nozzle from the supply fitting 22. The easy bayonet-type attachment is the same as that described above in relation to the embodiment of FIGS. 1–5 and locks the nozzle in place in a specific orientation each time. As was the case in the first-described embodiment, the slotted opening 104 is designed to be oriented at a similar offset angle illustrated at 120 in FIG. 6.

This embodiment also includes a flow regulating insert stem 122 having a first end 124 designed to be received in the supply fitting 114 and a second end 126 designed to be received in the spray tip/cap body system to supply spray material to the spray tip. However, this embodiment contains an additional insert 128 in the form of a cross-hair diffuser insert including integral cross-hairs 130. The cylindrical portion 132 of the diffuser 128 is designed to be removably push fitted into the end 126 of the metering or flow-regulating insert 122 and may be thereafter axially oriented relative to the main cap using a rotatable location key (not shown) in a well known manner. As was the case with insert 30 shown in FIG. 4, a shoulder 134 is shown on member 122 which is designed to abut a corresponding recess shoulder 136 in the spray tip/cap structure. The spray nozzle system connection to the fitting 114 is made liquid tight by the addition of an O-ring 138 designed to nest against the ridge 134 of the insert stem 122 sealing it to the end of the fitting 114 at 140 when the nozzle system is assembled onto the fitting 114.

In accordance with one aspect of the present invention the elongated slot-shaped discharge opening of the spray nozzle system of the present invention accords several distinct advantages. It has been found that the combination of the elongated slot-shaped discharge opening and the metering device combine to produce a spray that is characterized by droplets that are much larger than those typically associated with flood type nozzles of the system of the present invention is designed to replace. Thus, it has been found that with the spray nozzle system of the present invention that the spray tip achieves spray droplets of an average size greater than 600 microns compared with normal flood tip droplets size of about 300 microns.

The tip is also designed for high velocity spraying which, in conjunction with increased droplet size, greatly reduces spray drift. The elongated slot-shaped discharge opening 14 in the spray tip 12, 102 is further designed to produce a wide-angle flat fan spray pattern which may subtend an angle greater than 90° and preferably subtends an angle of about 160°. This pattern may be further defined or sharpened by the use of the slot shroud 106 in conjunction with the spray tip and additional stability and pattern definition may be obtained by the addition of the cross-hair diffuser insert 128. The offset angle between the elongated slot-shaped discharge opening and cap body of the spray nozzle system ensures that consecutive flow patterns generated by consecutive tips attached to an elongated boom manifold do not interfere with each other. The typical nozzle of the class of the present invention is capable of spraying approximately 2 gallons/minute at a pressure differential of 40 psi. Using interchangeable flow regulating inserts, however, enables one to change or replace the regulator as desired to modify the performance of the system including the flow rate and range of the fan spray, etc. It should be noted further that spray nozzle system of the present invention is designed to be interchangeable with existing nozzle cap body receiving fittings as depicted at 22 in FIG. 4 and 114 in FIG. 9.

The metering stem or flow regulating insert stem 30, 122 is rather elongated which facilitates removal for cleaning when necessary. In addition, the gradual radiused profile of the flow regulating insert reduces erosive wear on the insert during use. The spray pattern is further enhanced by the use of a large cross-sectional bore area between the metering orifice and the spray tip which slows liquid flow at higher pressures.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention itself.

What is claimed is:

1. A spray nozzle system comprising:

a spray tip including an elongated slot-shaped discharge opening for defining a flat fan spray pattern that subtends a wide angle;

a cap body carrying said spray tip and adapted to attach said spray tip to a supply fitting for a source of material to be sprayed;

a flow regulating insert carried in said spray tip for connecting said spray tip to said source of material to be sprayed and for controlling the amount of flow through said tip;

the spray tip, the cap body, and the flow regulating insert defining a flow path along a single axis.

2. A spray nozzle system as in claim 1 wherein said flow regulation insert is removable and interchangeable with other inserts to modify tip flow performance.

3. A spray nozzle system as in claim 1 wherein said spray pattern subtends an angle of about 160°.

4. A spray nozzle system as in claim 1 wherein said spray tip and said cap body are designed to be mounted on and attached to a supply manifold in aligned spaced relation to other like spray tips such that consecutive spray patterns overlap but do not interfere with each other.

5. A spray nozzle system as in claim 1 wherein said spray tip outlet opening in conjunction with said flow regulating insert produces spray pattern of large droplets.

6. A spray nozzle system as in claim 5 wherein said droplets have an average size≧600 microns.

7. A spray nozzle system as in claim 1 wherein said flow regulating insert includes a metering orifice.

8. A spray nozzle system as in claim 2 wherein said flow regulating insert includes a metering orifice.

9. A spray nozzle system as in claim 1 further comprising a sealing device between said cap and flow regulating insert.

10. A spray nozzle system as in claim 9 wherein said sealing device is an 0-ring.

11. A spray nozzle system as in claim 1 wherein said spray tip and said cap are formed as a unitary structure.

12. A spray nozzle system as in claim 1 wherein said cap further includes a bayonet style twist-on retaining structure which cooperates with a supply fitting on said source to removably secure said cap on said source in a predetermined orientation.

13. A spray nozzle system as in claim 2 wherein said flow regulation insert is snap-fit in place.

14. A spray nozzle system as in claim 1 wherein said spray tip, cap and insert are constructed of moldable materials.

15. A spray nozzle system as in claim 14 wherein said moldable materials include polymeric materials.

16. A spray nozzle system as in claim 1 further comprising a slot shroud flanking said slot-shaped discharge opening.

17. A spray nozzle system as in claim 1 further comprising a cross-hair diffuser insert associated with said flow regulating insert.

18. A spray nozzle system as in claim 16 further comprising a cross-hair diffuse insert associated with said flow regulating insert.

19. A spray nozzle system as in claim 17 wherein said cross-hair diffuser insert is push fitted into said flow regulating insert.

20. A spray nozzle system as in claim 18 wherein said cross-hair diffuser insert is push fitted into said flow regulating insert.

* * * * *